United States Patent [19]

Kyper

[11] Patent Number: 4,471,550

[45] Date of Patent: Sep. 18, 1984

[54] FLINT ASSEMBLY FOR FLINTLOCK FIREARMS

[76] Inventor: Thomas W. Kyper, 1310 Mt. Vernon Ave., Huntingdon, Pa. 16652

[21] Appl. No.: 388,541

[22] Filed: Jun. 15, 1982

[51] Int. Cl.[3] ..... F41C 27/00

[52] U.S. Cl. ..... 42/51; 42/1 N; 42/69 R

[58] Field of Search ..... 42/51, 69 R, 1 N; 431/274, 275

[56] References Cited

U.S. PATENT DOCUMENTS

| | | | |
|---|---|---|---|
| 2,912,841 | 11/1959 | Racek et al. | 431/275 |
| 3,247,611 | 4/1966 | Wilson | 42/51 |
| 3,744,169 | 7/1973 | Straight | 42/51 |
| 4,146,358 | 3/1979 | Dixon | 431/274 |
| 4,348,829 | 9/1982 | Bosco et al. | 42/1 N |
| 4,422,255 | 12/1983 | Lapp | 42/51 |

*Primary Examiner*—Charles T. Jordan

*Attorney, Agent, or Firm*—Brady & O'Boyle & Gates

[57] ABSTRACT

A flint assembly for a flintlock firearm having a housing containing a flint and carrying a flint wheel, the flint assembly being clamped between the hammer jaws of a conventional flintlock firearm.

10 Claims, 6 Drawing Figures

FLINT ASSEMBLY FOR FLINTLOCK FIREARMS

BACKGROUND OF THE INVENTION

In conventional muzzleloading firearms, a flintlock is employed wherein a hammer, carrying a flint, strikes a frizzen positioned over a flash pan containing priming powder, to thereby produce a shower of sparks to ignite the powder. Heretofore, the flints employed required the skill of an artisan to form the flint into the desired shape and size in order to produce the required sparks when the flint strikes the frizzen. With the decline in the use of flintlock firearms, good handmade gunflints and the art of producing them also declined resulting in inferior flints to the dissatisfaction of gun-buffs interested in flintlock firearms.

To meet the demand for better sparking and longer lasting gunflints, it has been proposed to employ flints and striking wheels, such as those used in cigarette lighters. Such an arrangement is disclosed in U.S. Pat. No. 3,247,611 to C. L. Wilson dated Apr. 26, 1966. While the flint assembly disclosed in this patent is satisfactory for its intended purpose, it is subject to certain objections such as being built into the gun between the barrel and the stock and, thus, becoming an integral part of the gun and, therefore, not readily replaceable. Furthermore, the flint assembly disclosed in the aforementioned patent did not satisfy the desire of gun-buffs interested in firing an old flintlock gun employing the conventional hammer and frizzen.

To overcome these objections, the flint assembly of the present invention has been devised wherein a housing containing a flint and flint striking wheel, of the type used in cigarette lighters, is clamped between the hammer jaws of a conventional flintlock firearm. By this construction and arrangement, when the firearm trigger is pulled, the hammer is moved in a direction toward the frizzen so that the flint striking wheel rolls along the frizzen and the relative movement therebetween causes the wheel to rotate against the flint, thereby producing a shower of sparks toward the flash pan. By clamping the flint assembly between the jaws of the hammer, the desire of gun-buffs interested in firing an old flintlock gun is satisfied, and it facilitates the replacement of the flint assembly when desired with a minimum of effort.

DESCRIPTION OF THE PREFERRED EMBODIMENT

Figure 1:
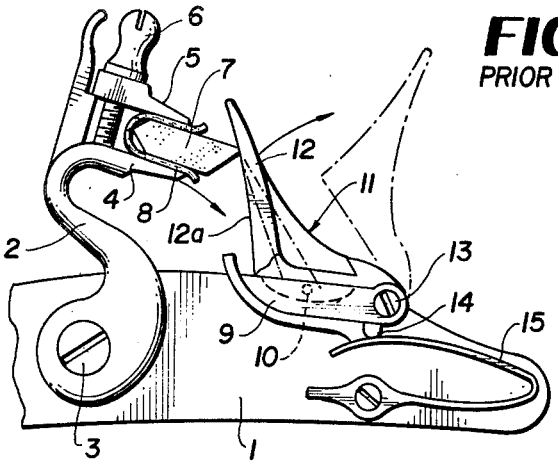
FIG. 1 PRIOR ART
FIG. 1 is a side elevational view of a prior art flintlock.

Referring to the drawing and more particularly to FIG. 1 thereof, a conventional flintlock mechanism includes a lock plate 1 attached to the gunstock, and a hammer 2 pivotally connected as at 3 to the lock plate. The hammer 2 is provided with a lower fixed jaw 4 and an upper jaw 5 movable relative to the fixed jaw by a suitable screw 6 for clamping a gunflint 7 therebetween, the flint 7 being firmly held in a fold of leather 8 between the jaws 4 and 5.

A flash pan 9 is provided in the plate 1 forwardly of the hammer 2 and is adapted to receive the conventional priming powder, a vent 10 extending from the pan 9 through plate 1 into the breech of the gun barrel. The gunstock, breech and barrel are not illustrated since their form and construction are conventional and are well-known to these skilled in the art.

An L-shaped cover 11 which includes the upstanding frizzen 12 having a curved striking face **12*a* is pivotally connected to the plate 1 as at 13. A horn 14 extending from the cover 11 engages a spring 15 in both the closed and open positions of the cover 11**.

In operation, after priming powder has been placed in the flash pan 9, the cover 11 is pivoted to the closed position covering the pan 9 as shown in solid lines. In this position of the cover 11, the frizzen 12 stands upright in the path of flint 7. When the hammer 2 is cocked, it is spaced rearwardly of the gun from the frizzen 12 so that when the trigger is pulled, the hammer 2 is released and the flint 7, carried by the hammer, snaps rapidly forwardly and strikes the curved surface **12*a* of the frizzen. The impact knocks the frizzen 12 forwardly of the gun causing the cover 11 to rise upwardly from the flash pan 9, as shown in dotted lines, thereby exposing the priming powder. The impact also creates the desired shower of sparks and directs them into the flash pan 9, thereby igniting the priming powder in the pan 9. The powder burns from the pan 9 through the vent 10** into the breech of the gun and a shot is fired.

Figure 2:
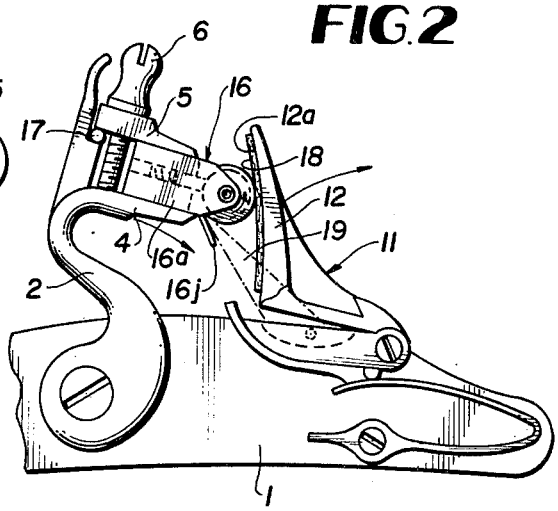
FIG. 2 is a side elevational view of the flintlock of the present invention.

As will be seen in FIG. 2, in lieu of the gunflint 7, the flintlock firearm of the present invention employs a flint assembly 16, of the type used in cigarette lighters, the flint assembly being clamped between the hammer jaws 4 and 5.

Figure 3:
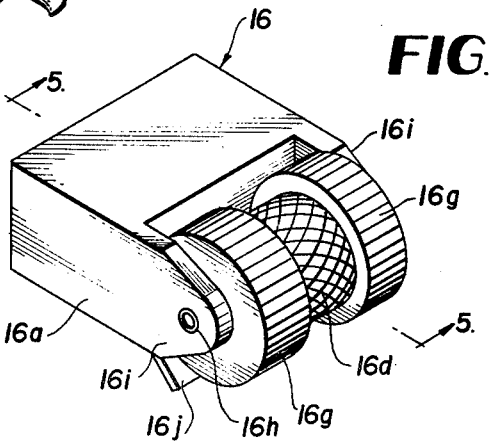
FIG. 3 is a perspective view of the flint assembly of the present invention.
Figure 4:
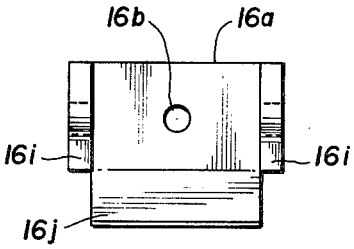
FIG. 4 is a front elevational view of the flint assembly with the flint wheel removed therefrom.
Figure 5:
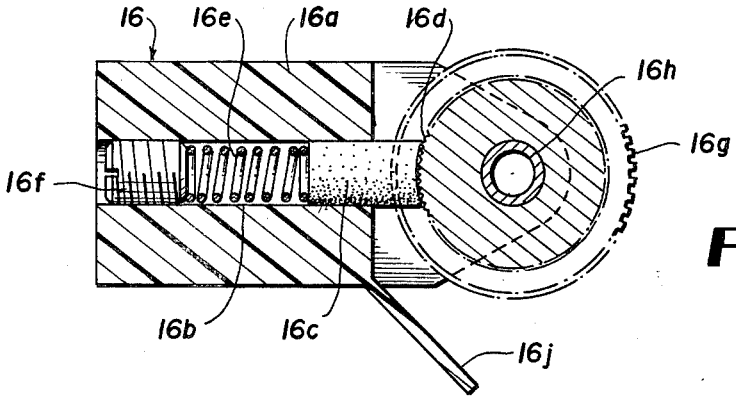
FIG. 5 is a view taken along line 5—5 of FIG. 3.

The details of the construction of the flint assembly 16 are shown in FIGS. 3, 4 and 5, wherein a housing **16*a* is provided with a bore 16*b* containing a flint stick 16*c*. One end of the flint stick 16*c* engages the peripheral surface of a flint striking wheel 16*d*, the flint stick 16*c* being biased against the flint wheel 16*d* by a compression spring 16*e* having one end abutting the end of the flint stick 16*c* and the opposite end abutting a set screw 16*f* threaded into the bore 16*b*. Each end of the flint wheel 16*d* is integrally connected to a friction wheel 16*g* having a diameter larger than that of the flint wheel 16*d*, the flint wheel 16*d* and associated friction wheels 16*g* being rotatably mounted as at 16*h* to a bifurcated arm 16*i* integrally connected to the housing 16*a* and projecting outwardly from one end thereof. A deflector 16*j* is integrally connected to the bottom of the housing 16*a* and extends downwardly and forwardly therefrom under the flint stick 16*c* and flint wheel 16*a*** for directing the spray of sparks into the flash pan, to be described more fully hereinafter.

As will be seen in FIG. 2, the flint assembly housing **16*a* is gripped between the hammer jaws 4 and 5 and, in order to maintain the jaws parallel when gripping the housing, a suitable shim 17 may be provided. A piece of suitable material 18, such as leather, is secured to the face of the frizzen to enhance the traction of the friction wheels 16*g*** thereagainst, and also to absorb the shock of the friction wheels when they strike the frizzen.

The operation of the flintlock firearm of the present invention is similar to that of the conventional flintlock firearm described hereinabove in connection with FIG. 1. With the flint assembly 16 clamped between the jaws 4 and 5, as shown in FIG. 2, and the hammer 2 cocked, the frizzen 12 will be in an upright position and the friction wheels 16*g* will be spaced rearwardly therefrom. When the trigger is pulled, the hammer 2 and associated flint assembly 16 snap rapidly forward, whereby the friction wheels 16*g* strike the frizzen 12 and roll thereon causing the flint wheel 16*d* to also rotate against the flint stick 16*c*, to thereby produce a shower of sparks 19 which are directed by the deflector 16*j* into the flash pan 9.

Figure 6:
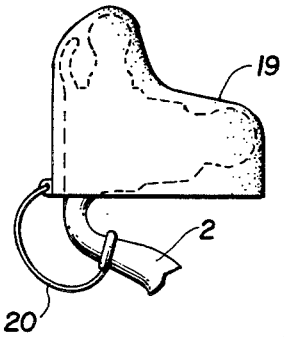
FIG. 6 is a side elevational view of a cover for the flint assembly of the present invention.

To complete the structure of the flint assembly, as will be seen in FIG. 6, a suitable cover 19 is provided to enclose the flint assembly when the flint assembly is mounted in operative position on the hammer 2. The cover 19 may take the form of a molded plastic shell configured to fit over the hammer jaws and flint assembly, a tether 20 being provided between the hammer 2 and cover 19 to prevent the cover from becoming misplaced when removed from the covering position. The cover 19 provides a rain cover to keep water from contacting the flint wheel 16*d* which, if wet, would result in a reduction of the spark.

From the above description, it will be readily apparent to those skilled in the art that the flint assembly of the present invention satisfies the desire of gun-buffs interested in firing an old flintlock gun employing the conventional hammer and frizzen. Other advantages include, keeping the spark constant by increasing the biasing force of the spring 16*e* against the flint stick 16*c* by turning the set screw 16*f*. The spark produced is substantially more dense than provided by conventional gun flints resulting in less misfires and requiring less flash pan powder than that required in conventional flintlock firearms.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In a flintlock firearm of the type wherein a hammer having jaws carries a flint assembly between the jaws thereof and adapted to strike a frizzen positioned over a flash pan containing priming powder to thereby produce a shower of sparks to ignite the powder, the improvement comprising the flint assembly including a housing clamped between the hammer jaws, a flint stick mounted within said housing and projecting from one end thereof, flint wheel striking means rotatably mounted on said housing, the end of said flint stick projecting from said housing engaging said flintwheel striking means, whereby when said flint wheel striking means strikes the frizzen the flint wheel striking means rolls along the frizzen and rotates against the flint stick to thereby produce a shower of sparks.

2. In a flintlock firearm according to claim 1, wherein a deflector is connected to the bottom of the housing for directing the shower of sparks into the flash pan.

3. In a flintlock firearm according to claim 2, wherein the deflector extends downwardly and outwardly from said one end of said housing under the flint stick and flint wheel striking means.

4. In a flintlock firearm according to claim 1, wherein a bore is provided within said housing, said flint stick being inserted in one end of said bore and projecting therefrom, a set screw threadably mounted in the opposite end of said bore, and a compression spring mounted within said bore between said set screw and said flint stick for biasing said flint stick against said flint wheel striking means.

5. In a flintlock firearm according to claim 1, wherein the flint wheel striking means comprises, a pair of parallel, spaced, friction wheels, and a flint wheel disposed within the space between said friction wheels and connected to said friction wheels, said flint wheel having a smaller diameter than said friction wheels, whereby the friction wheels engage the frizzen and roll thereon causing the flint wheel to rotate against the flint stick.

6. In a flintlock firearm according to claim 5, wherein a piece of material is secured to the face of the frizzen for absorbing the shock of the friction wheels when they strike the frizzen and to enhance the traction of the friction wheels thereagainst.

7. In a flintlock firearm according to claim 6, wherein the material is leather.

8. In a flintlock firearm according to claim 5, wherein a bifurcated arm is connected to said one end of the housing, said friction wheels and associated flint wheel being rotatably mounted on said bifurcated arm.

9. In a flintlock firearm according to claim 1, wherein a rain cover is provided for covering the flint assembly when mounted on said hammer.

10. In a flintlock firearm according to claim 9, wherein said rain cover comprises a molded plastic shell configured to fit over the hammer jaws and flint assembly.

* * * * *